United States Patent [19]

Kelly

[11] 4,143,413

[45] Mar. 6, 1979

[54] LUMINAIRE MOUNTING ARRANGEMENT

[76] Inventor: James P. Kelly, Cudahy, Wis.

[21] Appl. No.: 776,623

[22] Filed: Mar. 11, 1977

Related U.S. Application Data

[63] Continuation of Ser. No. 621,420, Oct. 10, 1975, abandoned.

[51] Int. Cl.[2] ..... F21V 21/00

[52] U.S. Cl. ..... 362/418; 362/431

[58] Field of Search ..... 362/382, 414, 418, 417, 362/421, 257, 269, 275, 285, 287, 289, 431

[56] References Cited

U.S. PATENT DOCUMENTS

| | | | |
|---|---|---|---|
| 2,434,986 | 1/1948 | Bremer | 240/73 BJ |
| 3,156,418 | 11/1964 | Jablonski et al. | 362/431 X |
| 3,254,205 | 5/1966 | Cobb | 362/285 X |
| 3,584,793 | 6/1971 | Ilzig et al. | 240/52 R |

*Primary Examiner*—J D Miller

*Assistant Examiner*—Peter S. Wong

*Attorney, Agent, or Firm*—Ronald J. LaPorte; Jon Carl Gealow; Thomas E. McDonald

[57] ABSTRACT

A fitter for mounting a luminaire, such as an outdoor floodlight, on a mounting member, such as a pole, employs three castings. A first casting is affixed to the luminaire and is rotatable with respect to a second casting, which is releasably connected to the mounting member. The mechanism for locking the first and second castings in the desired angular position with respect to one another is enclosed within the castings. A chamber in the second casting contains electrical connections between power lines and electrical leads to the luminaire, as well as a portion of the locking mechanism. This chamber is enclosed by a third casting. Mounting of the second casting on the mounting member is achieved by the utilization of tapered surfaces, which permits use of different sized poles, and the second casting is clamped to the pole by set screws at the corners of the second casting, which has a base portion with a substantially square cross section.

15 Claims, 7 Drawing Figures

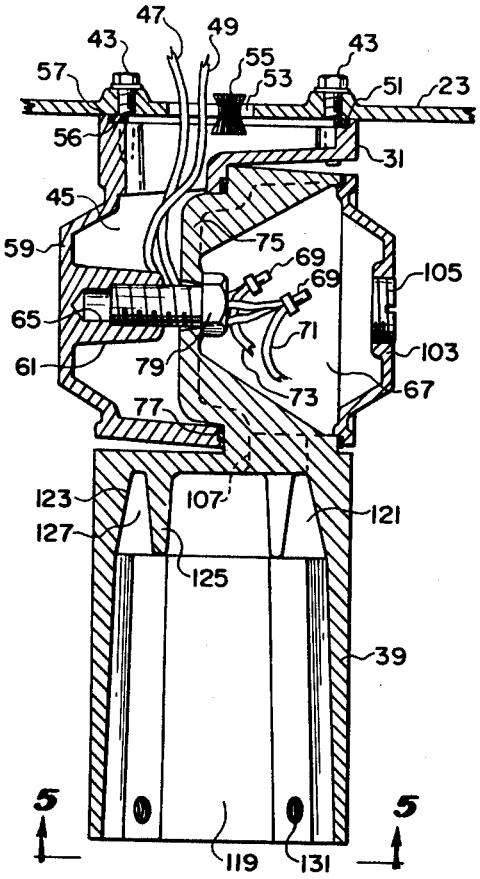
FIG. 4
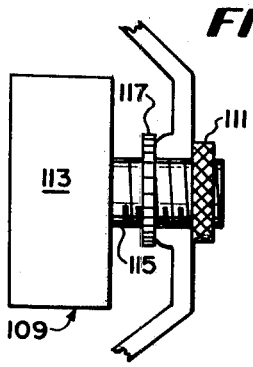
FIG. 6
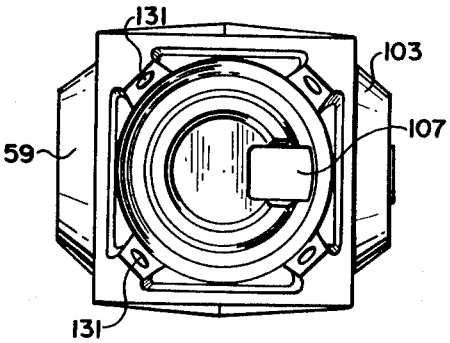
FIG. 5
FIG. 7
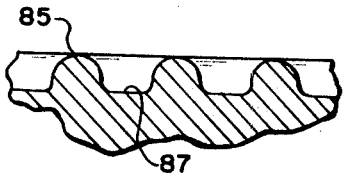

LUMINAIRE MOUNTING ARRANGEMENT

This is a continuation of application Ser. No. 621,420 filed Oct. 10, 1975 now abandoned.

BACKGROUND OF THE INVENTION

1. Field of the Invention

This invention relates generally to an arrangement for mounting a luminaire, and more specifically, this invention relates to a fitter for mounting an outdoor floodlight on a pole.

2. Description of the Prior Art

In mounting a luminaire, such as a floodlight, on a pole or tenon, it is desirable to be able to adjust the vertical angular displacement of the luminaire to give the desired lighting effect. It is also desirable to be able to determine the amount of angular displacement that has been achieved. While prior art devices have been utilized in which the vertical angular displacement could be varied, such arrangements have involved many difficulties, such as being too complex, not providing an indication of the amount of angular displacement, being unstable and lacking the requisite strength. In addition, the locking of the desired angular displacement is usually achieved by use of a metallic object, such as a screw or bolt, which rusts when exposed to the weather and makes future adjustments difficult.

Besides the angular adjustment aspect, it is also desirable to have the electrical connections between the power lines and the leads to the luminaire located in an area that is not exposed to the weather, in order to limit electrical failures.

Another important aspect of a luminaire fitter or mounting arrangement is that a strong connection must be made between the fitter or mounting arrangement and the mounting member or pole. Further, it is desirable that the fitter be useful for more than a single size of pole or mounting member, without sacrificing the strength of the connection between the fitter and the pole.

Still further, it is necessary that arrangements be made for introducing power lines externally (i.e., other than through the pole, which is the normal practice) and to provide for use of a photocontrol device, when desired. As the customer may wish to add the photocontrol feature at a time subsequent to the original purchase, it is desirable that this photocontrol feature be readily inserted into an existing system.

Prior art arrangements have, at best, only touched upon the various problems discussed above in connection with properly mounting a luminaire.

SUMMARY OF THE INVENTION

The present invention relates to a luminaire mounting arrangement which obviates many of the difficulties of prior art devices and provides many advantageous features. This mounting arrangement, or fitter, is broken into three separate sections, each of which may be a separate casting. The first section or casting is bolted or otherwise affixed to the bottom of the housing of luminaire. A metal-to-metal joint between the first casting and the luminaire housing is necessary to yield the requisite strength, but the joint must also be waterproof. This is achieved by a gasket inset with respect to the outer portion of the part of the first casting engaging the luminaire housing. This first casting has a hollow interior through which the electrical leads for the luminaire may be passed. In addition, a post having a threaded interior bore is securely fastened to the first casting, such as being integrally cast therewith, and extends through the hollow portion of this first casting toward an opening therefrom. This post is actually seated in a protrusion that extends away from the opening.

A second section or casting has a head portion and a base portion. The head portion includes a chamber in which the electrical leads for the luminaire may be connected to lines from an electrical power source. A trunnion extends from the head portion in a direction away from the chamber. This trunnion is inserted into the opening in the first casting in order to support the luminaire. A threaded bolt is passed through the trunnion in order that the threads thereof may mesh with the threads on the post to lock the first and second castings together, with the luminaire in the desired vertical angular position. The action of the locking bolt is assisted by interlocking ribs located about the opening in the first casting and about the trunnion of the second casting. An indication of the angular displacement of the luminaire is achieved by calibrated marks located on the first casting about the protrusion thereon, in conjunction with an indicating mark or arrow placed on the second casting in the vicinity of the marks on the first casting.

By having the locking bolt located in the chamber of the second casting, with the mating post in the hollow portion of the first casting, the locking mechanism is protected from the weather and hence retains the characteristic of permitting easy adjustment of the vertical angular displacement of the luminaire. In addition, the precise angular displacement is maintained by the interlocking ribs, and an indication of the angular displacement is provided. Of course, the location of the electrical connections in the chamber of the second casting protects these connections from the weather, and hence limits the possibility of electrical failure. Further, the combination of one chamber for both protection of the electrical components and the position locking bolt simplifies the overall handling and helps limit the size of the fitter.

The chamber of the second casting is enclosed by a third section or casting which serves as an easily removable cover for the chamber. A protrusion is also formed on this casting, and a removable member, such as a threaded plug or knock-out, is located in the middle thereof. This threaded plug or knock-out may be removed to permit the introduction of external lines, such as if the power line is not run up through the pole as in the normal situation, and also permits the placing of a photocontrol device in this closure member. The electrical portion of the photocontrol device is located on the inner side of this third section of casting, so that it is positioned in the chamber of the second casting. Only the photosensitive device itself extends through the opening in the closure casting.

Securing of the luminaire to the mounting member or pole is achieved by utilization of the base portion of the second casting. This base portion has a rectanguloid body with a substantially square cross section. An inner cavity permits the introduction of the mounting member or pole, and at the inner end of the cavity there is formed a tapered bore to provide for centering and seating more than one size of pole, such as a pipe or tenon. In addition, a projecting member can be formed to fit within the mounting pole, in which case the side of the projection nearest the pole is also tapered. The tapers for both the bore and the projection may be any desired angle, but it has been discovered that a 15° taper for both is especially advantageous.

The second casting is secured to the mounting pole by set screws located at each corner of the body. By utilizing the set screws at these positions, a tension force, rather than a bending force, is relied upon, and a much stronger and more secure connection is made, with less danger of failure of the casting.

By exploitation of the present invention, a floodlight may be securely mounted on a pipe or tenon and the angular inclination of the floodlight may be easily set at the desired value. In addition, the electrical connections between the electrical leads to the floodlight and the power lines are easily accessible, along with the locking arrangement for the vertical angular setting of the floodlight, and a photodetector is easily installed.

These and other objects, advantages and features of this invention will hereinafter appear, and for purposes of illustration, but not of limitation, an exemplary embodiment of the subject invention is shown in the appended drawing.

BRIEF DESCRIPTION OF THE DRAWING

FIG. 4 is a cross-sectional view of the mounting structure of this invention.

FIG. 5 is a plan view taken along lines 5—5 of FIG. 4.

FIG. 6 is an enlarged view of a portion of FIG. 4 illustrating utilization of a photocontrol device.

FIG. 7 is an enlarged fragmentary view illustrating the interlocking ribs of the locking arrangement.

DETAILED DESCRIPTION OF THE PREFERRED EMBODIMENT

Figure 1:
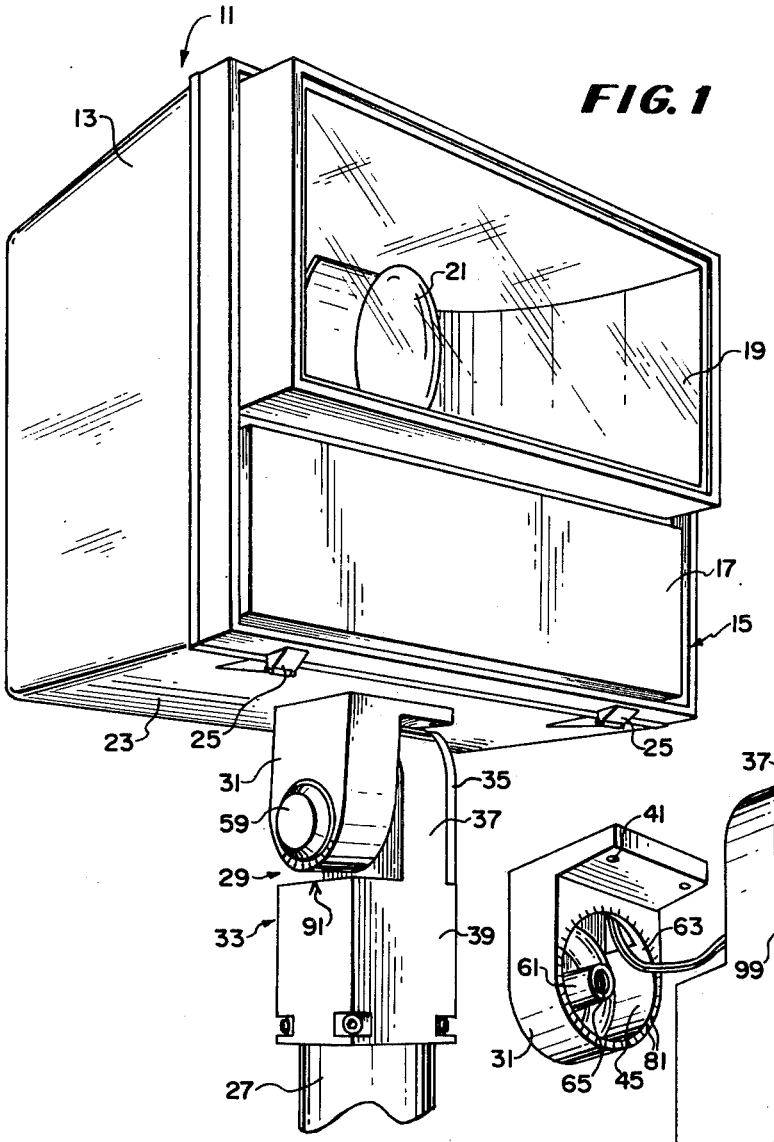
FIG. 1 is a left front prospective view of a luminaire mounted in accordance with the present invention.

With reference to FIG. 1, a luminaire 11 is illustrated. Luminaire 11 includes a housing 13, which has an open front sealingly enclosed by a door 15. Door 15 has an opaque lower panel 17 and a transparent upper panel, such as a lens 19. A lamp 21 is energized to provide the desired lighting pattern through lens 19. The door 15 is mounted to the bottom 23 of housing 13 by hinges 25.

The luminaire 11 is mounted on a mounting member, such as a conventional pole (pipe or tenon) 27, by a mounting arrangement or fitter 29 of this invention. The mounting arrangement 29 includes a first section or casting 31, a second section or casting 33, and a third section or casting 35. The second casting 33 has a head portion 37 and a base portion 39.

Figure 3:
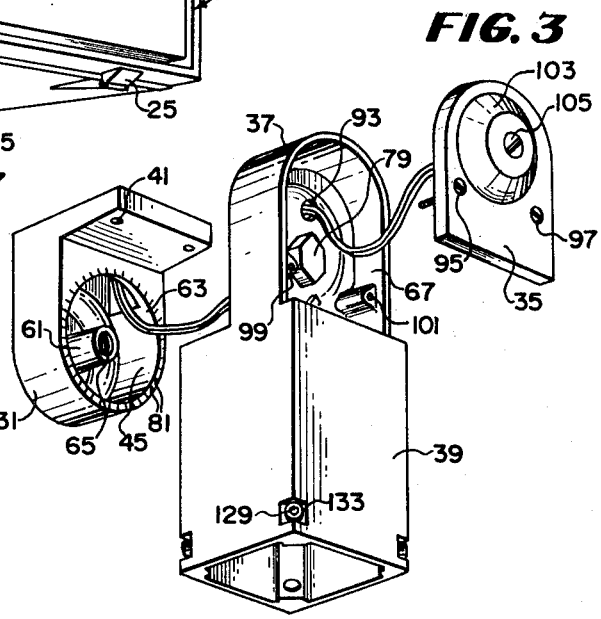
FIG. 3 is an enlarged exploded view similar to FIG. 2 but from a different angle.
Figure 2:
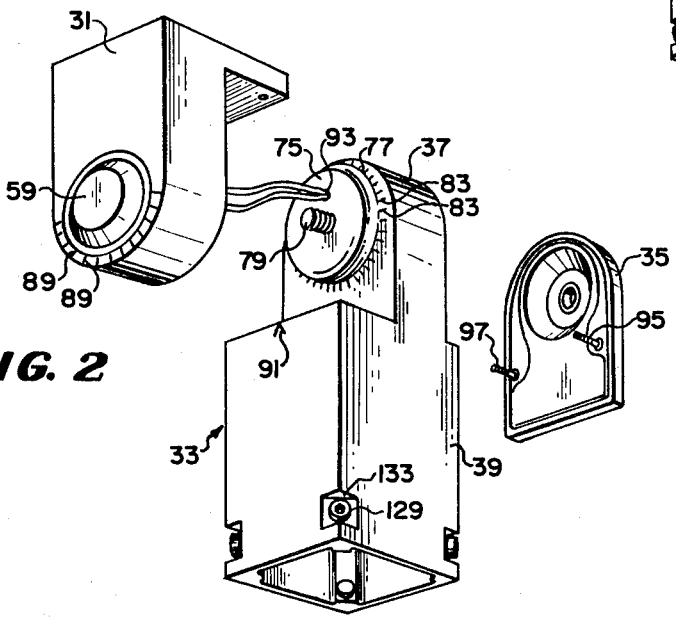
FIG. 2 is an enlarged exploded view of the improved mounting arrangement or fitter of the present invention illustrated in FIG. 1.

With reference to FIGS. 2–4, the overall structure of the mounting arrangement 29 may be seen in greater detail. The first section or casting 31 has a plurality of mounting openings 41 (in this preferred embodiment four such openings are used) into which appropriate connectors, such as bolts 43 (FIG. 4), are passed through the bottom 23 of housing 13. These bolts 43 securely affix casting 31 to housing 13 of the luminaire 11. Casting 31 is essentially hollow as represented by the hollow portion 45. Leads 47 and 49, which are utilized to energize the luminaire 11, pass through the hollow portion 45, a gasket 51 and an opening 53 in the bottom 23 of luminaire 11. A filter 55 is also passed through the opening 53 and gasket 51 to interconnect the inner side of luminaire 11 to the air which passes through castings 31 and 33, while filtering out contaminants.

It should be noted that a shoulder 56 is formed at the top of the casting 31, so that the gasket 51 does not cover the entire top of casting 31. Thus, a rim 57 at the top of casting 31 will bear against the bottom 23 of luminaire 11, to ensure that a metal-to-metal contact is provided, while at the same time the gasket 51 provides the desired waterproof seal.

A protrusion 59 is formed on the casting 31 and has a post 61 affixed thereto and extending therefrom. Post 61 extends through the hollow space 45 toward opening 63, which permits ingress to and egress from hollow space 45. Post 61 is provided with a threaded bore 65.

Head portion 37 of casting 33 encompasses a chamber 67 in which are enclosed electrical connections 69 for connecting leads 47 and 49 to lines 71 and 73, which are in turn connected to a source of electrical power. Luminaire 11 is supported by a trunnion 75 which extends outwardly from casting 33 to engage the cooperative opening 63 in casting 31, and hence support casting 31, and thereby luminaire 11. A knuckle gasket 77, in the form of an O-ring or other cross section, is placed about the base of trunnion 75 to engage the portion of casting 31 about opening 63 to provide a watertight seal.

A threaded bolt 79 extends from chamber 67 through trunnion 75 to the bore 65 of post 61. When the threads of the bolt 79 mesh with the threads of the bore 65 of post 61, the casting 33 is locked in position with respect to casting 31, in order to maintain the luminaire 11 in the desired angular position with respect to a vertical axis, thereby establishing the desired vertical angular displacement. The locking of casting 31 and 33 is assisted by the interlocking ribs 81 and 83, which are located about opening 63 and trunnion 75, respectively. By reference to FIG. 7, the structure of the interlocking ribs 81 and 83 may be more clearly understood. From this FIG. 7, it maybe seen that each of the sets comprises a priority of extending ribs 85 and a series of grooves 87. When the luminaire 11 is rotated to the desired vertical angular displacement, the ribs 85 of one set mesh with the grooves 87 of the other set and help to sustain the desired position. These ribs are not so large as to interfere with the relative movement between castings 31 and 33 when bolt 79 is loosened, but primarily provide an additional locking effect upon tightening of bolt 79.

An indication of the angular displacement of the luminaire 11 is provided by calibrated marks 89 located about the protrusion 59, when taken in conjunction with an indicator, such as arrow 91 (which could also be a simple vertical mark) formed on casting 33. As the angular position of luminaire 11 is altered, casting 31 will be rotated with respect to casting 33, and the arrow 91 will indicate the angular declination by its alignment with one of the calibrated marks 89.

Incidentally, it should be noted that the leads 47 and 49 pass out of chamber 67 through an opening 93 in the trunnion 75. These leads then pass through the hollow space 45 of casting 31 and continue on to the luminaire 11, through opening 53.

Casting 35 provides a cover for chamber 67 and is removably held in place by the captive retaining screws 95 and 97, which are inserted into corresponding receptacles 99 and 101 in chamber 67. A protrusion 103 is formed on this casting, and a threaded plug 105 (which could also be a knock-out) is located in the protrusion 103. Threaded plug 105 may be removed to permit the introduction of external leads into chamber 67. For example, the power lines are usually extended into chamber 67 from the pole 27 through opening 107. However, in some cases, a solid pole might be utilized or for some other reason the power lines must be passed into chamber 67 from the outside of the fitter 29. This may be accomplished by removing plug 105 and inserting the power lines through the resulting opening, usually with an appropriate gasket or other sealing arrangement to provide a watertight seal.

Another utilization of the opening provided by removal of plug 105 is illustrated in FIG. 6. In this case, a photocontrol device 109 is utilized to automatically turn the luminaire 11 on and off, depending upon ambient light conditions. A photosensitive device 111 is located externally of casting 35 and supported on a threaded shank 115, while the other portions of the device, such as the electrical circuitry, are located in chamber 67, as depicted generally by the numeral 113. The threaded shank 115 also supports the electrical circuitry 113, while appropriate connections are made between the device 111 and electrical circuitry 113. A washer 117 positions the photocontrol device 111 and electrical circuitry 113 with respect to the plug opening.

Connection of casting 33 to the pole 27 is achieved in the rectanguloid body of base portion 39. The pole or mounting 27 is first inserted through a cavity 119. At the inner end of cavity 119, there is a bore 121 having a substantially circular cross section. However, the bore 121 has a tapered side 123, so that as the mounting pole is inserted beyond cavity 119 it is centered and seated in the base portion 39. To further improve this aligning and seating function, a projection 125 may be utilized to fit inside the pipe or tenon. This projection is also formed with a tapered side 127. A particularly desirable taper for both sides 123 and 127 has been found to be about 15°.

After the mounting pole has been inserted into the bore 121, it is secured in place by set screws 129, which are passed through holes 131 formed in the base portion 39. The holes 131, and hence the set screws 129, are located at the four corners of the substantially square cross section base portion 39. In order to simplify the fitting of the set screws, flat portions 133 may be formed at each of the four corners. The advantage of utilizing set screws at the corners is that this places a tension force on the casting 33, rather than the bending force that would be produced if the set screws were located along the flat side of this square cross section, or inserted through a circular cross section.

It should be understood that various modifications, changes and variations may be made in the arrangements, operations and details of construction of the elements disclosed herein without departing from the spirit and scope of this invention.

I claim:

1. A mounting arrangement for a floodlight or the like outdoor luminaire having a housing, including in combination:

a first section attachable to said housing of said luminaire, said first section defining a hollow portion and an opening into one side thereof, an internally threaded member being seated in said hollow portion with the free end of said member extending toward said side opening, a second section releasably connectable to a mounting member having a circular cross section, said second section having integrally formed head and base portions, the head portion defining a chamber in which electrical leads from said luminaire are connectable to lines from a source of electrical power, a trunnion formed on and extending from said head portion, said trunnion being dimensioned for receipt in said side opening of said first section, said trunnion providing support to said first section and luminaire, a threaded locking bolt passing through said trunnion into said internally threaded member of said first section for securing said first and second sections in selected positions with respect to each other, said sections being rotatable with respect to each other upon loosening said locking bolt for adjusting the angular position of said luminaire attached to said first section, mating locking ribs provided about said side opening of said first section and said trunnion, respectively, to assist in securing said first and second sections in a selected position, said base portion including a body defining a cavity for receipt of said mounting member, with a tapered bore at the internal end of said cavity to align and seat the end of said mounting member, and a third section attachable to said second section in covering relation with respect to said cavity, thereby to seal said cavity and electrical leads therein.

2. A mounting arrangement as claimed in claim 1 and further comprising clamping means in said body to secure said second section to the mounting member.

3. A mounting arrangement as claimed in claim 2 wherein said body is rectangular with a substantially square cross section; and said clamping means comprises a set screw at each corner of said body near the point at which the mounting member enters the cavity.

4. A mounting arrangement as claimed in claim 3 wherein the corners of said body are flattened at the points where said set screws are inserted.

5. A mounting arrangement as claimed in claim 1 wherein the taper of said bore is 15°.

6. A mounting arrangement as claimed in claim 1 and further comprising a projection extending outwardly from the closed end of said bore at a diameter to fit within the mounting member, the side of said projection adjacent the mounting member being tapered.

7. A mounting arrangement as claimed in claim 1 wherein: said internally threaded member extends from a protrusion that enlarges said hollow portion of said first section;

calibrated marks are placed about said protrusion; and an indicator is located on said second section to cooperate with said calibrated marks to provide an indication of the vertical angular displacement of the luminaire.

8. A mounting arrangement for a luminaire comprising:

a first section affixed to the housing of the luminaire, said first section including a first support portion;

a second section releasably connected to a mounting member, said second section including a second support portion, said second support portion engaging said first support portion to support said first section on said second section, said first and second sections being rotatable with respect to each other to adjust the angular position of the luminaire with respect to a vertical axis;

a chamber formed in said second section and containing electrical connections between electrical lines from a source of electrical power and electrical leads to the luminaire;

locking means to fixedly determine the rotational position of said first section with respect to said second section, and actuatable portion of said locking means being located in said chamber; and a third section enclosing said chamber, said third section comprising a removable member therein, removal of said removable member permitting the introduction of external electrical leads to said chamber, wherein said removable member includes a photocontrol attached to said third section.

9. A mounting arrangement as claimed in claim 8 wherein said removable member is located in a protrusion that extends away from said chamber.

10. A mounting arrangement as claimed in claim 8 wherein said first section is a casting comprising:

an outer rim engaging the luminaire housing with a metal-to-metal joint; and a recessed shoulder containing a gasket to provide a watertight seal internally of the metal-to-metal joint.

11. A mounting arrangement for a luminaire comprising:

a first casting affixed to the housing of the luminaire, said first casting having a hollow portion therein and an opening to said hollow portion;

a post secured to said first casting and extending through said hollow portion toward said opening thereof, said post having a threaded bore therein;

a second casting releasably connected to a mounting member;

a head portion of said second casting having a chamber formed therein, said chamber containing electrical connections between lines to a source of electrical power and leads to the luminaire;

a trunnion extending from said second casting into said opening in said first casting to support the luminaire;

a threaded bolt passing through said trunnion, the threads of said bolt meshing with the threads of said threaded bore of said post to lock said first and second castings in a position relative to one another that yields the desired vertical angular displacement of the luminaire;

interlocking ribs about said opening in said first casting and said trunnion in said second casting to ensure stability of the locking engagement between said first and second castings;

a cavity in a base portion of said second casting, said base portion having a substantially square cross section;

a bore at the inner end of said cavity having a taper to center and seat more than one size mounting member;

set screws at each corner of said base portion adjacent the entrance to said cavity to clamp said second casting to the mounting member;

a third casting to provide a cover for said chamber; and a threaded plug in said third casting which is removable to permit the insertion of external wiring into said chamber.

12. A mounting arrangement as claimed in claim 11 and further comprising a projection into the center of the mounting member, said projection being tapered on the side adjacent the mounting member, the tapers of both said bore and said projection being 15°.

13. A mounting arrangement as claimed in claim 11 and further comprising:

calibrated marks on said first casting; and a cooperating indicator on said second casting to provide an indication of the vertical angular displacement of the luminaire.

14. A mounting as claimed in claim 11 wherein said threaded plug may be removed from said third casting to permit insertion of a photocontrol device.

15. A mounting arrangement as claimed in claim 11 wherein said first casting comprises:

an outer rim engaging the luminaire housing with a metal-to-metal joint; and a recessed shoulder containing a gasket to provide a watertight seal internally of the metal-to-metal joint.

* * * * *

UNITED STATES PATENT AND TRADEMARK OFFICE

CERTIFICATE OF CORRECTION

PATENT NO. : 4,143,413

DATED : Mar. 6, 1979

INVENTOR(S) : James P. Kelly

It is certified that error appears in the above-identified patent and that said Letters Patent are hereby corrected as shown below:

On the cover page of the patent following Item [76] Inventor and preceding Item [21] Appl. No., insert--
Assignee: McGraw-Edison Company, Elgin, Illinois --

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*